United States Patent [19]

Swain

[11] Patent Number: 4,854,838

[45] Date of Patent: Aug. 8, 1989

[54] HYDRAULIC PUMP GATE APPARATUS

[76] Inventor: David O. Swain, 52 Carriage Hill Lane, Laguna Hills, Calif. 92653

[21] Appl. No.: 885,153

[22] Filed: Jul. 14, 1986

[51] Int. Cl.[4] ..... F04B 7/00

[52] U.S. Cl. ..... 417/517; 417/518; 417/900; 137/125.18

[58] Field of Search ..... 417/900, 517; 137/625.18

[56] References Cited

U.S. PATENT DOCUMENTS

| | | | |
|---|---|---|---|
| 3,098,480 | 7/1963 | Worthington | 417/517 X |
| 3,228,340 | 1/1966 | Hubbard | 417/900 X |
| 3,494,377 | 2/1970 | Thuse | 137/625.18 |
| 3,682,575 | 8/1972 | Guddal et al. | 417/517 |
| 3,908,865 | 9/1975 | Day | 417/900 X |
| 3,909,160 | 9/1975 | Sherrod | 417/517 |
| 4,288,206 | 9/1981 | Tigwell et al. | 417/517 |
| 4,472,118 | 9/1984 | Schwing | 417/900 X |
| 4,527,953 | 7/1985 | Baker et al. | 417/540 X |
| 4,718,826 | 1/1988 | Simmer | 417/900 X |

*Primary Examiner*—Carlton R. Croyle
*Assistant Examiner*—Ted Olds
*Attorney, Agent, or Firm*—G. Donald Weber Jr.

[57] ABSTRACT

An improved, hydraulically controlled pump for coarse, viscous material such as, but not limited to, concrete, and a gate mechanism for the pump.

25 Claims, 3 Drawing Sheets

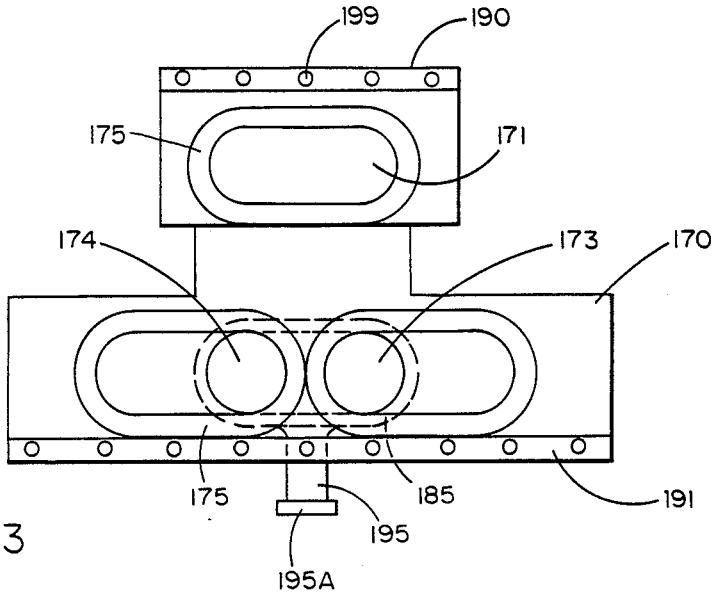
FIG. 3
FIG. 6
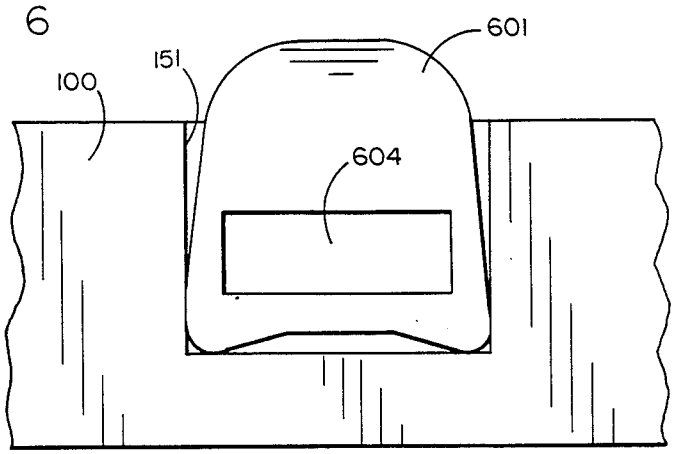

HYDRAULIC PUMP GATE APPARATUS

BACKGROUND

1. Field of the Invention

This invention is directed to pumps, in general, and, more particularly, to hydraulically controlled pumps which are used to pump coarse, viscous materials such as concrete.

2. Prior Art

There are many types of pumping machines which are known in the art. These pumps vary in function from those which are used to pump fluids such as gaseous materials, through pumps for liquids, to those types of pumps which are used to pump highly viscous, particulate material. The known pumps can be used to pump other materials such as slurries, granular material or the like. One particular type of pump apparatus which is well known in the art is used to pump concrete from a mixer apparatus to a remote location of utilization. These pumps are frequently hydraulically powered so as to provide a sufficient force to move the relatively heavy concrete mixer. Many of the existing pumps use a ball valve to control the flow of concrete from the input source to the delivery line.

However, in many cases, a relatively dense or coarse concrete mixture is required for various applications. With this type of concrete, it is virtually impossible to use the existing ball valve in the pump. That is, the dense and/or coarse material tends to become congested in the ball valve. This effect causes the pump to become clogged and inoperative.

In the past, a gate or spade valve has been utilized but has been relatively ineffective because of leakage, excessive wear and other shortcomings. Thus, the existing gates have been relatively ineffective and undesirable. Therefore, a new and improved gate arrangement is highly desirable.

SUMMARY OF THE INSTANT INVENTION

This invention is directed to a new and improved gating apparatus which is especially useful in conjunction with a pumping apparatus by which dense or coarse fluids are to be pumped. The gate is a hydraulically controlled, double-acting gate arrangement. It is able to selectively control the flow of the plastic-type material in a system which is controlled, at least in part, by a hydraulic pump. In this apparatus, a plate is caused to be selectively moved between at least two operative positions to control the flow of the material therefrom. A push-pull type of pumping operation is utilized.

The gating apparatus includes highly effective and highly accurate seal mechanisms which operate to prevent leakage at the gating mechanism, especially at the interface between the sliding plate and the ports of the pumping apparatus.

BRIEF DESCRIPTION OF THE DRAWINGS

FIG. 3 is a plan view of the upper plate portion of the gate apparatus of the pump system.

FIG. 6 is a cross-sectional view of a portion of the seal mounted within the sliding plate portion of the instant invention.

DESCRIPTION OF PREFERRED EMBODIMENTS.

Figure 1:
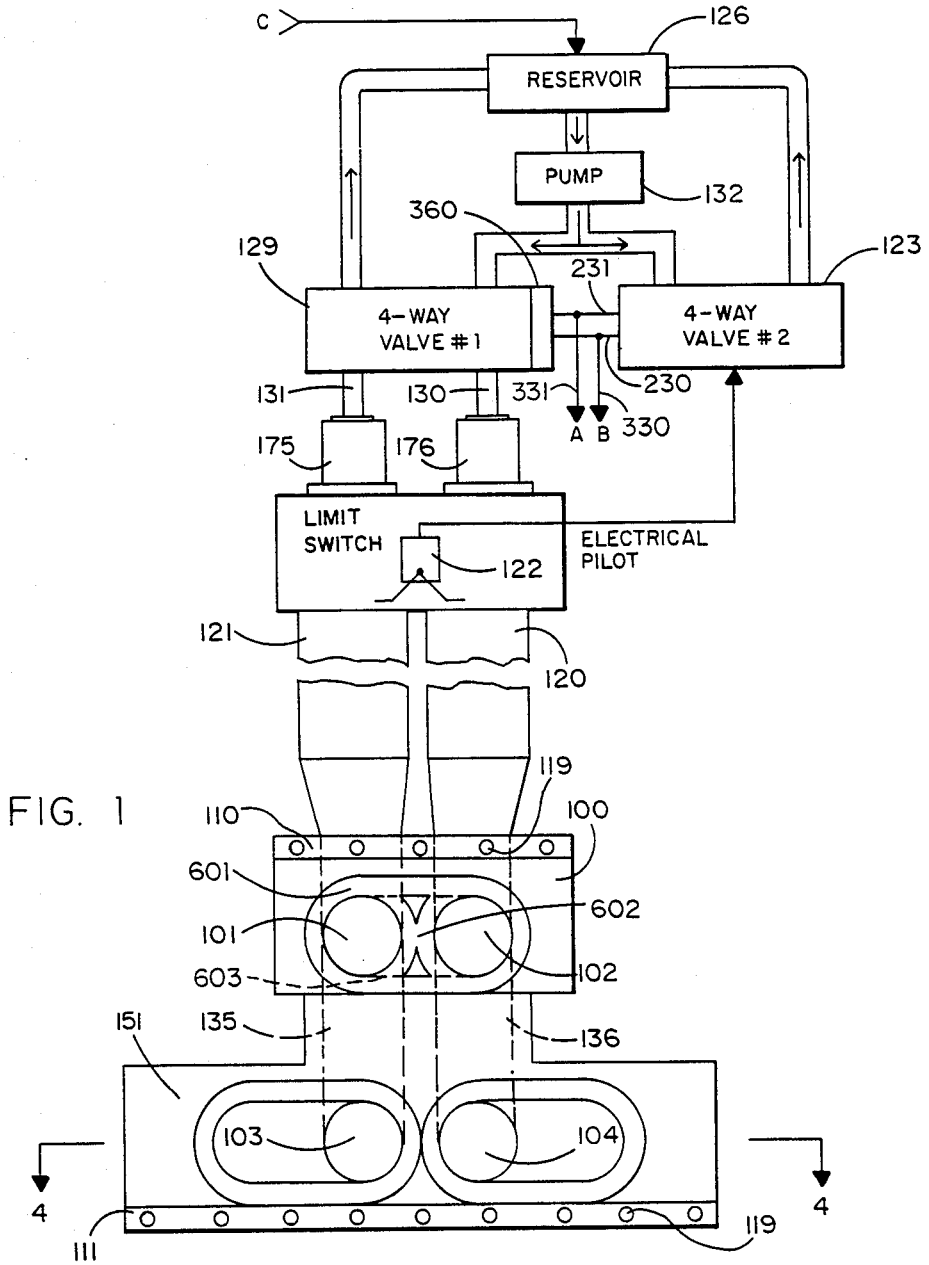
FIG. 1 is a schematic representation of the major portions of a hydraulic pump apparatus in accordance with the instant invention, including a plan view of the lower plate portion.

Referring now to FIG. 1, there is shown a schematic representation of a hydraulic pump which is used to pump fluids, especially, particulate or coarse fluids, such as concrete or the like. Of course, other particulate materials can be pumped, as well. The pump includes a port plate 100, which includes the ports 101, 102, 103 and 104. Each of these ports communicates with suitable conduits 135 and 136 (shown dashed in FIG. 1 but shown and described more particularly in FIGS. 4 and 5). Each of these ports includes an annular groove 151 (or recessed portion) adjacent to the mouth of the port and adapted to receive a seal 501 (or a modification thereof), as described hereinafter.

The plate 100 is, typically, a planar plate with a fairly smooth finish so as to provide a satisfactory sliding and sealing surface for the gate apparatus. Side or edges bars 110 and 11 are shown disposed on opposite sides of port plate 100. Suitable apertures 119 or the like can be provided in one or more places in each of these side bars in order to permit fixing or joining thereof to other portions of the apparatus, as described hereinafter. Of course, the apertures can be formed in plate 100 directly and without side bars 110 or 111.

Chambers 120 and 121 are disposed adjacent to the port plate 100. In particular, the chambers 120 and 121 communicate with certain of the ports in the port plate 100 by way of conduit 135 or conduit 136, respectively. In particular, chamber 120 communicates with ports 102 and 104 by way of conduit 136, while chamber 121 communicates with ports 101 and 103 by way of conduit 135, respectively.

More particularly, the chambers 120 and 121 are cylinders which include hydraulically operated pistons therein. The cylinders are constructed so that the material to be pumped is inserted (or drawn) into the cylinder when the piston (not shown) in the cylinder is retracted. Conversely, when the piston in the respective chamber is driven, the material which has been stored in the cylinder is forced out of the cylinder via the appropriate conducting conduit.

Figure 2:
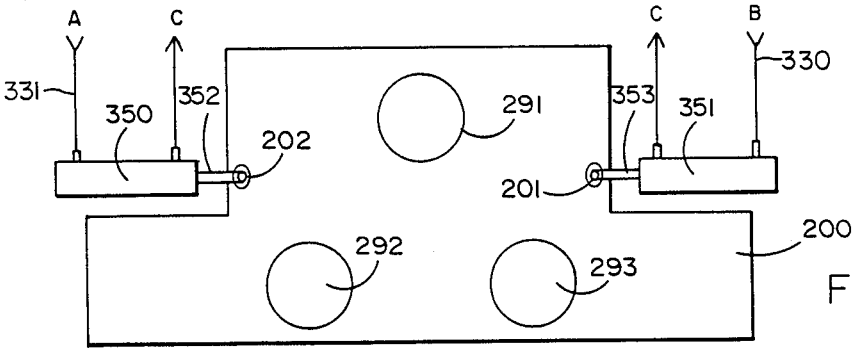
FIG. 2 is a plan view of the sliding plate portion of the gate apparatus of the pump system.

In the preferred embodiment, the chambers 120 and 121 are arranged and adapted to operate in a push-pull operation. That is, when chamber 120 is filling with material, chamber 121 is dispensing material, and vice versa. This operation is controlled, at least in part, by the limit switch apparatus 122 which is disposed adjacent one end of both of the chambers 120 and 121. The switching apparatus 122, typically, includes an electrically controlled limit switch of conventional design. The limit switch apparatus 122 is connected to a switching mechanism 123 which is, in a preferred embodiment, a four-way hydraulic valve which permits hydraulic fluid from the reservoir 126 to be supplied as the pilot hydraulic supply to another switching mechanism 129 which can also be a four way hydraulic valve. The pilot hydraulic fluid supply is conducted between pilot switch valve 123 and control valve 129 by the conduits 230 and 231. In addition, the hydraulic fluid is supplied to the mechanism for driving gate plate 200 (as shown in FIG. 2). In particular, the fluid is conducted to the gate plate via conduits 330 and 331 which may be connected to conduits 230 and 231, respectively by T-couplers, for example. The connections of the conduits to the gate mechanism are made at the terminals A and B. Under control of four-way valve 129, pump 132 supplies hydraulic fluid from reservoir 126 under pressure to the piston in one of chambers 120 or 121 via the hydraulic lines 130 or 131. This pressure fluid drives the piston in the appropriate cylinder.

In operation, assume that material to be pumped by the apparatus of the invention is selectively inserted into the cylinders 121 and 120 via the ports 101 or 102, and removed via ports 103 and 104, respectively. As material is supplied via port 101, assume that the piston in cylinder 121 is being retracted by operation of the hydraulic system. For example, the hydraulic fluid is pumped through conduit 131 into resevoir 126. The material supplied at port 101 is, thus, fed into the chamber 135 by gravity feed and is drawn into cylinder 121 by means of a suction effect when the piston therein is withdrawn. At the same time, the piston in the cylinder 120 is moved forward by hydraulic fluid pumped through conduit 130 from reservoir 126 to expel any material which has been previously stored in cylinder 120. (In the start-up mode, the cylinders are each assumed to be substantially empty.) The fluid paths are determined by the position of valve 129 which is controlled by pilot valve 123.

When the piston in cylinder 121 reaches a prescribed location in its inward travel, it trips limit switch 122. Switch 122 causes the hydraulic valve 123 to be reversed in operation. In this case, hydraulic fluid from reservoir 126 is now pumped into line 230 and out of line 231 via pilot valve 129 to provide the hydraulic fluid pilot supply to valve 129. This change in fluid supply causes valve 129 to shift positions. When valve 129 shifts position in response to the pilot supply, hydraulic fluid is pumped by pump 132 from reservoir 126 into line 131 and out of line 130. As a consequence, the piston in cylinder 121 is now forced forward, while the piston in cylinder 120 is withdrawn. As a result of the operations of the pistons, the material which has just been stored in chamber 121 is pushed therefrom while material is drawn into chamber 120 by means of gravity feed and suction as noted above.

As will become apparent infra, a suitable gating apparatus has concurrently been activated to open port 102 to receive material to be placed in cylinder 120 via chamber 136, while port 101 has been closed to prevent material from cylinder 121 from being expelled through port 101. If this were not the case, the material would be merely returned to the place from whence it came.) In addition, the gate apparatus has opened port 103 whereupon the material in cylinder 121 is now pumped or expelled through conduit 135 (shown dashed) and out through open port 103. At the same time, port 104 is closed in order to prevent the materials applied through port 102 from inadvertently escaping through port 104 via conduit 136.

Referring now to FIG. 3, there is shown an outlet plate 170 which is disposed over the port plate 100. The outlet plate 170 includes ports 171, 173 and 174 which are arranged to cooperate with the inlet ports 101, 102, 103 and 104, respectively. That is, outlet port 171 cooperates with inlet ports 101 and 102 while ports 173 and 174 cooperate with ports 103 and 104, respectfully. (Note that as shown in FIG. 3, the bottom of the port plate 170 is shown. When assembled, the plate shown in FIG. 3 is flipped and the illustrated surface is placed adjacent to the surface of plate 100 shown in FIG. 1. Thus, ports 173 and 174 may appear reversed.)

Each of the outlet ports includes an annular groove or recess 175 which is adapted to receive a seal shown and described in detail infra. These grooves (and seals) are similar to those shown in port plate 100 in FIG. 1.

In the preferred embodiment, the port plate 170 is joined to the bottom of hopper 180 (see FIG. 5) which is used for supplying materials, as shown hereinafter. The feed port 171 is, essentially, a common port, through which materials are supplied to input ports 101 and 102, respectively.

Figure 4:
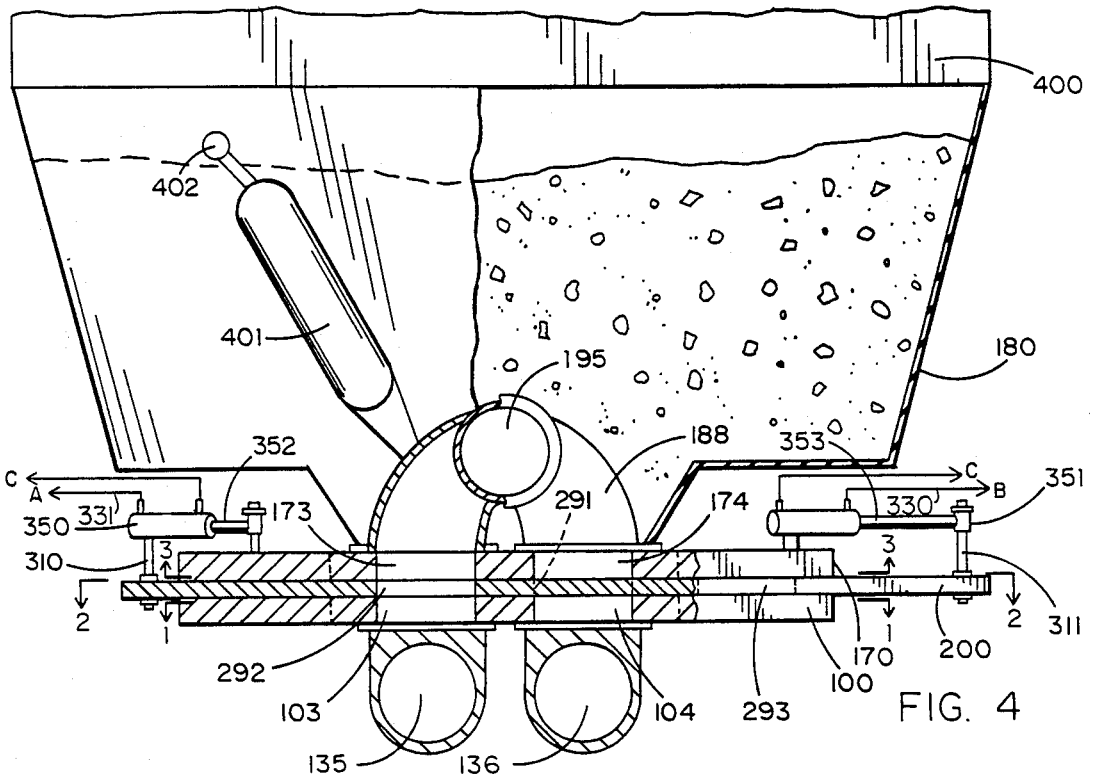
FIG. 4 is a schematic, partially cross-sectional end view of the gate appartus of the instant invention.

In similar fashion, the ports 173 and 174 are joined together by a conduit 185 (see FIG. 4). Typically, conduit 185 includes a rear discharge outlet port 195, which can include a suitable connection 195A flange or the like. It is clear, that the arrangement of the conduit 185 and the port 195 are a matter of design and may be rearranged to provide a side discharge, if desired, for convenience.

The upper port plate 170 is shown to include the side bars 190 and 191, as well as suitable apertures 199. As with plate 100, the side walls can be used or not by suitable design. However, the upper port plate 170 is arranged to be mounted over (and aligned with) the lower port plate 100 to provide the inlet and outlet arrangements for transmitting the materials which are supplied from the hopper 180, to and/or from the cylinders 120 and 121.

Referring now to FIG. 2, there is shown a plan view of the gate element of the instant invention. The gate element comprises a gate plate 200, which has ports 291, 292 and 293 therethrough. These ports are arranged to selectively coincide with pairs of ports disposed in plates 100 and 107. That is, ports 291 and 292 are arranged to mutually cooperate with ports 102 and 103, respectively, of plate 100. Conversely, ports 291 and 293 are arranged to cooperate with ports 101 and 104, respectively, of plate 100. On the other hand, port 291 cooperates with port 171 at all times, while ports 292 and 293 communicate with ports 173 or 174 as a function of the position of plate 200. Of course, plate 200 is also designed to be sufficiently rigid and structurally strong to prevent passage of the materials (or deformation of the plate by the materials) which are being handled by the apparatus through any port or conduit which is not adjacent to a port in plate 200.

Thus, when plate 200 is disposed between the lower (input) port plate 100 and the upper (output) port plate 170, only two ports are 'open' at any time. By properly positioning and controlling plate 200, these two ports are arranged to be opened in concert with each other. For example, when ports 291 and 292 cooperate with ports 102 and 103, material is supplied from hopper 180 through feed port 171 and, via ports 291 and 102, to cylinder 120. However, material is not permitted to enter cylinder 121 inasmuch as plate 200 blocks the passage from port 171 to port 101.

On the other hand, material in cylinder 121 is permitted to pass through ports 103, 292 and 173 into conduit 185 and out the outlet port 195. Also, it is seen that material cannot pass into conduit 120 via port 104, inasmuch as ports 174 and 104 are both blocked by plate 200.

When plate 200 is shifted so that ports 291 and 293 cooperate with ports 101 and 104, a similar arrangement occurs between hopper 180 and the cylinders 120 and 121.

It should be understood, furthermore, that the direction of passage of material through the ports can be reversed. That is, it is possible for material to be drawn into the cylinder via port 103 or 104 and expelled through port 101 or 102 by appropriate arrangement of the various ports vis-a-vis the operation of the gate plate 200 in connection with the operation of the cylinders, as controlled by the hydraulic fluid.

The plate 200 also includes appropriate mounting or attachment means 201 and 202. In one embodiment, the mounting means 201 and 202 represent fixtures or bolts at the ends of plate 200 to which appropriate connecting rods 352 and 353 can be mounted. The rods are joined to hydraulic rams 350 and 351, respectively. The rams 350 and 351 are connected to the hydraulic system of FIG. 1 via the terminals labelled A, B or C in these drawings.

Referring now to FIG. 4, there is shown a schematic, partially cross-sectional view of the gate taken along the lines 4—4, in FIG. 1. In the embodiment shown in FIG. 4, the gate plate 200 is disposed between the respective lower and upper plates 100 and 170. The alignment of ports 103, 292, 173 is shown. The blockage between ports 104 and 174 is also demonstrated. However, the position of port 291 is shown, in dashed outline. This also represents the relationship between ports 102 and 171 which are located behind ports 104 and 174, respectively. Also, it is clear that that port 293 (shown dashed) is disposed out of engagement with any of the other ports in the gate apparatus.

The relationship between ports 103 and 104 and the respective conduits 135 and 136 is demonstrated in FIG. 4. Likewise, the arrangement of hopper 180 and the gate apparatus are also demonstrated.

An apparatus for moving the gate plate 200 is depicted. This apparatus includes hydraulic cylinders 350 and 351 together with hydraulically moved piston rods 352 and 353. Cylinders 350 and 351 are joined to gate plate 200 by means of suitable mounting devices 310 and 311 shown as connecting bolts or the like. These mounting devices are similar to the mounting elements 201 and 202 shown in FIG. 2. Also, the rods or pistons 352 and 353 are fastened to plate 170 by suitable bolts. Other methods of effecting this connection are contemplated. Also, a single push/pull cylinder arrangement can be effected in some applications.

The hydraulic cylinders 350 and 351 are connected to the four way hydraulic valve 123 (see FIG. 1) by means of suitable hydraulic lines 330 and 331. Hydraulic fluid is supplied by reservoir 126 (at port C) while the return lines are connected to the reservoir via valve 123 (at ports A and B, respectively).

In typical operation, the hydraulic devices 350 and 351 are connected to and controlled by the hydraulic apparatus shown in FIG. 1. That is, when the limit switch 122 is triggered to reverse the operation of the push-pull piston/cylinder arrangement, the hydraulic devices 350 and 351 are also caused to operate so that gate plate 200 is shifted, in this instance, to the left, to reverse the operation of the pump apparatus. Thus, the full or charged cylinder (120 or 121), either of cylinders 120 or is evacuated and the empty or discharged cylinder is concurrently filled. However, the gating arrangement of this invention prevents any cross linking of the filling and emptying devices. In addition, because of the seals around the respective ports, no leakage occurs in the system.

In an optional embodiment, a separate valve 360 can be used in conjunction with valve 129 to manually cross couple the feed lines 230 and 231 so as to reverse the operation of cylinders 350 and 351 together with the respective pistons. By reversing the operation of the hydraulic apparatus, gate plate 200 is shifted at a different time sequence relative to the operation of cylinders 120 and 121. That is, in the alternative operation, port 291 of plate 200 is aligned with a port 101 or 102 when the cylinder in the associated chamber 120 or 121 is in the forcing or expelling stage, and ports 292 and 293 are aligned with ports 103 or 104, respectively, when the appropriate cylinder 120 or 121 is in the suction stage. In this operation, the apparatus operates to pump the material from the discharge line to the hopper.

Figure 5:
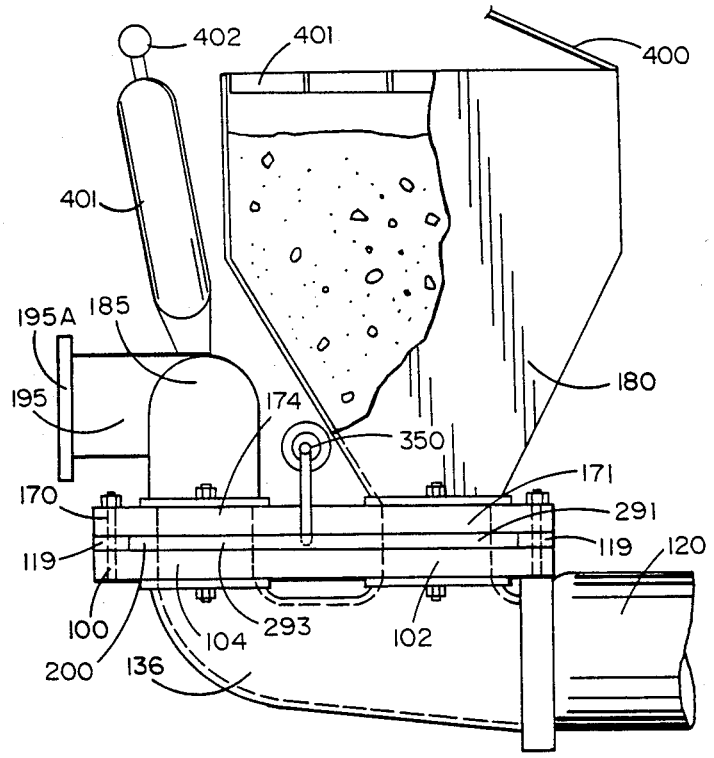
FIG. 5 is a schematic, partially cross-sectional side view of the gate apparatus of the instant invention.

Referring now to FIG. 5, there is shown a schematic, partially-cross section view of the instant invention. In this arrangement, the assembled components are show the alignment of ports 104, 174 and 293 (or, alternatively, 292). Likewise, FIG. 5 shows the alignment of ports 102, 171 and, when appropriate, 291.

The hydraulic switching cylinder 350 is shown disposed between the conduit 185 and hopper 180. The hopper may take any suitable form or configuration and the design thereof forms no portion of this invention, per se. However, a hinged lid 400 and a protective grate 401 are shown. The conduit 136 is shown interconnecting ports 104 and 102, as well as chamber 120.

The conduit 185 and the connecting flange 195 are shown in a rear projecting arrangement. Alternatively, a side-projecting arrangement is shown in dashed outline. Clearly, any suitable arrangement is contemplated. The specific configuration is not a portion of this invention, per se.

In addition, a surge chamber or accumulator 401 is shown connected to conduit 185. A pressure gauge 402 is disposed at the outer end of pressure tank 401. In typical operation, the surge chamber 401 is charged with pressurized inert gas and stores energy during the discharge (material being pumped) of conduits 120 and 121, respectively. During the brief interval when cylinders 175, 176, 350 and 351 are changing direction, there occurs a momentary pause in the material flow. At these times, the surge chamber discharges an appropriate amount of the gas stored therein thereby keeping material moving in the discharge line. As the system is operating, there are experienced relatively slow times of pumping. The flow of materials in the apparatus is reduced at these times. However, at these times, the pressurized gas in the surge chamber 401 is applied to the system. This pressure tends to cause the concrete or other material being pumped to continue moving. Thus, the surge chamber operates to provide a more constant flow of material through the system. Maintaining this constant flow, has the advantage of ease of distribution of the pumped material and, as well, ease of handling. That is, a pump which is pumping in an erratic or sporadic fashion will tend to create a 'whip' action at the end of a flexible concrete pumping hose, which is very difficult for operators to manipulate.

Referring now to FIG. 6 there is shown a cross-sectional view of the seal 601 which is used in the grooves 151 related to the ports 103 171 and so forth in FIGS. 1 and 3, respectively. The seal 601 is a, generally, oval configuration with a central cross-member 602 (see FIG. 1). The central cross-member 602 can be removed (as suggested by dashed lines 603) to form an open, oval ring seal.

The seal 601 is comprised of a basic core which is fabricated of a suitable elastomer material such as urethane or the like. This material is used because it is somewhat deformable, yet highly durable. An internal core 604 is formed of steel or similar material which is used to provide structural strength.

Typically, the seal 601 is placed in the appropriate seal groove 151 or 175 adjacent to the ports 101–104, 171, 173 and 174, as noted above. The central cross member 602 can be removed to provide the oval configuration, if so desired. The seal extends or protrudes out of the recess or groove 151, as shown in FIG. 6. When the several plates are assembled, the seal is squeezed between the plates. Thus, the seal is placed against the surface of slide plate 200 and provides a very close tolerance fit therewith. Consequently, the seal tends to reduce the losses between the plates.

Moreover, because the resilient seal 601 is of a suitable elastomer it is permitted to be deformed slightly in response to pressure applied thereto by the material being pumped through the instant apparatus. This deformation is adapted to take place in the direction so that the seal becomes more closely fitting to the surfaces of the respective plates. Consequently, a pressure applied to the seal has an advantageous effect of improving the sealing characteristics.

Thus, there is shown and described an improved pumping device and apparatus. The pumping apparatus of this invention includes a double-acting gate arrangement which is especially useful when pumping a viscous material. The gate permits advantageous operation of the pump, especially with very coarse material. In addition to the gate apparatus, per se, the invention includes a unique seal arrangement which improves the operating characteristics of the pump.

It is clear that a preferred embodiment of the invention has been shown and described. It is also clear that those skilled in the art may conceive of modifications to the pump apparatus as described in detail above. However, any such modifications which fall within the perview of this description are intended to be included therein as well. The above description is intended to be illustrative only and is not intended to be limitative of the invention. The scope of the invention described herein is limited only by the claims appended hereto.

I claim:

1. In combination with an apparatus for feeding coarse granular material, a gate device comprising, first, second and third planar plate means of substantially the same size and configuration, said first and second plate means being substantially fixed in position and including at least three aligned apertures therethrough, said third plate means disposed intermediate said first and second plate means and including at least three apertures therethrough, said third plate means adapted to be movable relative to said first and second plate means such that the apertures through said third plate means are selectively aligned with less than all of the apertures through said first and second plate means thereby ton control passage of said coarse granular material through said apertures in said first and second plate means.

2. The combination recited in claim 1 including, seal means disposed around said apertures in each of said first and second plate means.

3. The combination recited in claim 1 including, hydraulic drive means for selectively moving said third plate means relative to said first and secnd plate means.

4. The combination recited in claim 1 including, supply means for supplying materials to be selectively passed through aligned apertures in said first, second and third plate means.

5. A concrete pump apparatus comprising, hopper means for supplying a concrete mix, a pair of piston/cylinder units for moving said concrete mix relative to said hopper means, gate means for selectively passing said concrete mix between said hopper means and said cylinder/piston units, said gate means including at least three parallel, planar plates each of which has at least three apertures therethrough for selectively passing said concrete mix therethrough, a first of said planar plates interposed between a second and a third one of said planar plates, said second planar plate connected to said hopper means, said third planar plate connected to said pair of piston/cylinder units, said first planar plate movable relative to said second and third planar plates, hydraulic control means connected to operate said pair of piston/cylinder units 180° out of phase and to move said first planar plate relative to said hopper means and said pair of piston/cylinder units in conjunction with the operation of said pair of piston/cylinders.

6. The combination recited in claim 4 wherein, said supply means comprises a hopper for storing said coarse granular material.

7. The combination recited in claim 2 wherein, said seal means has a generally oval outer peripheral configuration.

8. The combination recited in claim 7 wherein, said seal means comprise a plurality of annular components joined together within an oval envelope such that the interior tangential areas of the annular components can be removed to produce an oval seal means.

9. The combination recited in claim 3 including, cylinder means aligned with said aligned apertures through said first and second plate means, piston means disposed in each of said cylinder means, said piston means arranged to be moved within said cylinder means by said hydraulic drive means.

10. The combination recited in claim 9 wherein, said piston means are moved by said hydraulic means in a concerted fashion to control the passage of said coarse granular material therethrough and the direction of said passage.

11. The combination recited in claim 1 including, first and second conduit means connected to said first plate means so as to interconect certain of said aligned apertures.

12. The combination recited in claim 11 including, third conduit means connected to said second plate means so as to interconnect certain of said aligned apertures transverse to the interconnection effected by said first and second conduit means connected to said first plate means.

13. The combination recited in claim 7 wherein,
said seal means includes an outer core formed of durable, resilient material and an inner core encompassed within said outer core and formed of a strong relatively rigid material.

14. The combination recited in claim 4 wherein,
said supply means is connected to said second plate means and aligned with at least one of said aligned apertures.

15. The combination recited in claim 3 wherein,
said hydraulic means includes piston means having one end affixed to said third plate means and the other end affixed to one of said first and second plate means whereby operation of said piston means causes said third plate means to be moved.

16. The combination recited in claim 12 wherein,
said third conduit means includes an outlet port through which said coarse granular material is transferred to a utilization means.

17. The combination recited in claim 12 including,
pressure means conected to said third conduit means to selectively provide pressure to the interior of said third conduit and any contents thereof.

18. The combination recited in claim 17 wherein,
said pressure means includes a surge tank which contains a pressurized fluid.

19. The combination recited in claim 10 including,
control means for coordinating the relative movements of said piston means and said third plate means.

20. The combination recited in claim 16 wherein,
said outlet port is disposed transverse to said third conduit means to provide a directional output path.

21. The combination recited in claim 19 wherein,
said control means includes switch means adjacent to said piston means to detect when said piston means has achieved a predetermined position.

22. The combination recited in claim 21 wherein,
said switch means comprises an electrical limit switch mounted at one end of said piston means.

23. The combination recited in claim 3 wherein,
said hydraulic drive means includes,
reservoir means for storing an hydraulic fluid,
pump means for pumping said hydraulic fluid under pressure, and
valve means for distributing said hydraulic fluid.

24. The combination recited in claim 2 wherein,
each of said first and second plate means includes grooves therein surrounding said apertures and to receive said seal means.

25. A concrete pump apparatus comprising,
hopper means for supplying a concrete mix,
a pair of piston/cylinder units for moving said concrete mix relative to said hopper means,
gate means for selectively passing said concrete mix between said hopper means and said cylinder/piston units,
said gate means comprising first, second and third planar plate means,
said first and secod plate means being substantially fixed in position and including at least three aligned apertures therethrough,
said third plate means disposed intermediate said first and second plate means and including at least three of apertures therethrough,
said third plate means adapted to be movable relative to said first and second plate means such that the apertures through said third plate means are selectively aligned with fewer than all of the aligned apertures through said first and second plate means thereby to control passage of said coarse granular material through said plurality of aligned apertures in said first and second plate means,
hydraulic control means connected to operate said pair of piston/cylinder units 180° out of phase relative to each other and to move said third plate means relative to said hopper means and said pair of piston/cylinder units in conjunction with the operation of said pair of piston/cylinders,
seal means disposed around said plurality of apertures in said first and second plate means,
said seal means has a generally oval outer peripheral configuration,
each of said first and second plate means includes grooves therein surrounding said apertures and adapted to receive sai seal means,
hydraulic drive means associated with said hydraulic control means for selectively moving said third plate means relative to said first and second plate means,
said piston/cylinder units comprising cylinder means aligned with said aligned apertures through said first and second plate means,
piston means disposed in each of said cylinder means,
said piston means arranged to be moved within said cylinder means by said hydraulic drive means,
first and second conduit means connected to said first plate means so as to interconnect certain of said apertures in said first plate means,
third conduit means connected to said second plate means so as to interconnect certain of said apertures in said second plate means transverse to the interconnection effected by said first and second conduit means connected to said first plate means,
said hopper means is connected to said second plate means and aligned with at least one of said apertures in said second plate means,
said hydraulic drive means includes piston means having one end affixed to said third plate means and the other end affixed to one of said first and second plate means whereby operation of said piston means causes said third plate means to be moved relative to said first and second plate means,
said third conduit means includes an outlet port through which said coarse granular material is transferred to a utilization means,
pressure means connected to said third conduit means to selectively provide pressure to the interior of said third conduit and any contents thereof,
said pressure means includes a surge tank which contains a pressurized fluid, and
control means for coordinating the operation of said hydraulic control means,
said control means includes switch means adjacent to said piston means to detect when said piston means has achieved a predetermined position condition,
said hydraulic control means includes,
reservoir means for storing an hydraulic fluid,
pump means for pumping said hydraulic fluid under pressure, and
valve means for distributing said hydraulic fluid.

* * * * *